United States Patent [19]

Luenser et al.

[11] Patent Number: 4,462,502

[45] Date of Patent: Jul. 31, 1984

[54] THREADED CLOSURE WITH LINER

[75] Inventors: Werner R. Luenser, Blue Island; Efrem M. Ostrowsky, Highland Park, both of Ill.

[73] Assignee: Ethyl Molded Products Company, Richmond, Va.

[21] Appl. No.: 400,746

[22] Filed: Jul. 22, 1982

Related U.S. Application Data

[63] Continuation-in-part of Ser. No. 379,065, May 17, 1982, abandoned, which is a continuation-in-part of Ser. No. 271,781, Jun. 8, 1981, abandoned, which is a continuation-in-part of Ser. No. 218,735, Dec. 22, 1980, abandoned.

[51] Int. Cl.[3] ..... B65D 53/04

[52] U.S. Cl. ..... 215/329; 215/350

[58] Field of Search ..... 215/329, 349, 350, 351, 215/270

[56] References Cited

U.S. PATENT DOCUMENTS

| | | | |
|---|---|---|---|
| 2,068,389 | 1/1937 | Smith | 215/350 |
| 2,130,749 | 9/1938 | Von Till | 215/350 |
| 2,409,788 | 10/1946 | Osborne . | |
| 2,409,789 | 10/1946 | Osborne . | |
| 2,550,586 | 4/1951 | Nardone | 215/350 X |
| 3,067,900 | 12/1962 | Kessler . | |
| 3,331,523 | 7/1967 | Exton | 215/350 |
| 3,462,034 | 8/1969 | Friedberg | 215/350 X |
| 3,536,224 | 10/1970 | Green . | |
| 4,151,924 | 5/1979 | Jameson . | |

FOREIGN PATENT DOCUMENTS

| | | | |
|---|---|---|---|
| 14100 | 11/1977 | Australia . | |
| 875454 | 5/1953 | Fed. Rep. of Germany . | |
| 969785 | 7/1958 | Fed. Rep. of Germany | 215/350 |
| 2115824 | 10/1971 | Fed. Rep. of Germany . | |
| 2137389 | 2/1973 | Fed. Rep. of Germany . | |
| 597052 | 3/1978 | Switzerland . | |
| 683521 | 12/1952 | United Kingdom . | |

*Primary Examiner*—Donald F. Norton

*Attorney, Agent, or Firm*—Donald L. Johnson; John F. Sieberth

[57] ABSTRACT

A closure for fitment to the threaded neck of a container is disclosed. The closure is especially adapted for use in packaging products such as carbonated beverages. The closure has a circular top wall and an annular skirt downwardly depending therefrom. The skirt carries about its inside surface a closure thread for cooperation with the neck thread of the container. A circular, flexible, resilient liner is positioned against but rotatable with respect to the inside surface of the top wall and has a diameter greater than the outside diameter of the container lip which defines the container mouth. There is provided an annular projection which is located adjacent the inside intersection of the top wall and the skirt. This projection has a configuration whereby it presses the liner on the outside edge of the container lip to form a gas-tight seal when the closure is fitted onto the container.

51 Claims, 8 Drawing Figures

THREADED CLOSURE WITH LINER

CROSS-REFERENCE TO RELATED APPLICATIONS

This applicaton is a continuation-in-part of our earlier filed application Ser. No. 379,065 filed May 17, 1982, now abandoned, which in turn is a continuation-in-part of our earlier filed application Ser. No. 271,781 filed June 8, 1981 now abandoned, which in turn is a continuation-in-part of our earliest filed application Ser. No. 218,735, filed Dec. 22, 1980, now abandoned.

BACKGROUND OF THE INVENTION

For many years it has been general practice to utilize bottles which are sealed by means of the so-called crown closure to package products which effect a positive pressure in the bottles. Exemplary of such products are carbonated beverages such as beer. The crown closure is commonly made of tinplate and its fluted skirt is engaged under a peripheral rib which extends around the neck of the bottle in close proximity to its mouth.

The crown closure suffers from two defects, namely, it requires a special tool to remove it from the bottle and it cannot be used to reclose the bottle. In recent years, non-returnable bottles have come into more general use and these have been adopted for some carbonated beverages. When non-returnable bottles are adopted, it is practicable to adopt the most convenient form of closure consistent with economy in price. The most widely employed form of non-returnable bottle system for carbonated beverages has employed a bottle with an externally screwthreaded neck, having a cylindrical sealing surface between the top of the bottle and the start of the thread. With this bottle, there has been employed a closure in the form of an aluminum shell having a gasket covering the inner surface of the top of the shell which forms a sealing liner. The diameter of the skirt of the closure shell is sufficiently large to fit over the thread on the bottle neck at the maximum size allowed by the range of tolerances set out in the specification of the neck finish of the bottle. The skirt of this shell is deformed by a threadrolling operation carried out in known way to bring it into engagement with the thread on the bottle neck.

While such aluminum closures have received wide acceptance, there is an economic problem due to the high cost of aluminum. Aluminum's high cost is directly proportional to the ever-rising high cost of energy as aluminum production is energy intensive.

A highly promising alternative to the use of aluminum closures is the use of closures made of thermoplastic material. Such materials are becoming more and more economically favorable when compared to aluminum. Exemplary of such closures is the one shown in U.S. Pat. No. 3,067,900. As desirable as it may be to use thermoplastic material, there is one serious drawback, i.e., the tendency of thermoplastic closures to lose their seal as positive pressure builds in the bottle. Since the seal is made by the closure making sealing contact with the bottle, the loss of seal is generally due to the closure flexing, as the pressure builds, resulting in the closure structure being distorted and pulled away from the bottle. To prevent flexing, it is possible to select a very rigid thermoplastic material. However, the seal sought to be obtained when using such materials is not always initially achieved as the rigidity of the material will not allow the sealing configuration to follow structural variations which are commonly present on the bottles. Also such rigid materials are often very expensive. Less expensive materials could be used if the flexing portion of the closure was made thicker to achieve the rigidity sought. But, as is obvious, the cost of such a thicker closure rises in direct proportion to the amount of material used and renders such closures commercially unacceptable.

With the economic realities in mind, it would be highly desirable to redesign the thinner commercial closures used today so that the flexing phenomena will not cause loss of seal but rather will be utilized to increase the fidelity of seal as internal container pressures build.

Therefore, it is an object of this invention to provide an inexpensive thermoplastic closure which is capable of maintaining a seal in response to a positive pressure in a container such as a bottle

THE INVENTION

This invention relates to a thermoplastic closure for fitment to a container having a threaded neck terminating in an open mouth. The closure has a circular top wall and an annular downwardly depending skirt, the skirt having about its inside surface a closure thread for cooperation with the container neck thread to achieve the fitment desired. There is positioned adjacent the top wall a circular, flexible, resilient liner which has a diameter greater than the outside diameter of the container mouth. There is also provided annular structure which is located adjacent the inside intersection of the top wall and the skirt. This annular structure has a configuration such that it presses the liner around the outside edge of the container mouth to form a gas-tight seal when the closure is fitted onto the container.

Preferably there is additionally provided a retaining ring about the inside surface of the skirt which is positioned below the annular structure but above the closure thread. This retaining ring prevents the liner from moving down to the closure thread. Thus, if the liner should fall away from the top wall, the retaining ring will prevent it from being separated from the remainder of the closure.

To aid in maintenance of the position of the liner in its sealing position with respect to the container, there is preferably additionally provided an annular tab which projects downward from the top wall. This tab will engage the liner and prevent any lateral movement thereof.

When the closure is originally fitted to the container, there are two principal sealing areas, i.e., there is a seal formed between the liner and the top of the container lip and a second seal formed between the outside edge of the lip and the liner. When the closure top wall begins to flex upwardly in response to positive pressure in the container, the first seal between the liner and the top of the container lip is compromised as the liner is no longer as well-supported due to upward flex of the top wall. However, due to the unique configuration of the closure of this invention, the upward flexing of the top wall increases the fidelity of the second seal as that portion of the liner which is wrapped around the outside edge of the container lip is pressed into a tighter relationship with the outside edge. This is due to the fact that the flexing of the top wall causes the upper portion of the container sidewall to be pulled inwardly. As the sidewall upper portion is pulled inwardly, the annular structure presses more firmly against the liner thereby increasing the fidelity of the seal. Thus, the closure of this invention utilizes the heretofore undesirable flexing of the top wall to increase the fidelity of the seal. This is directly opposite to present-day closures in which the upward flexing of the top wall results in a reduction in a seal fidelity.

There are different configurations which the annular structure can have to achieve the above-mentioned seal between the liner and the outside edge of the container lip. For example, the annular structure can have a configuration, which, when viewed in cross-section, has a horizontal portion, a vertical portion, and a convex portion, with the convex portion connecting the horizontal portion and the vertical portion one to the other. When utilizing this configuration, there is a concentration of sealing pressure at a point near the center of the convex portion. Another configuration is one in which the annular structure is a convex bead. By utilizing a convex bead the pressure exerted by the annular structure is distributed over a wider area of the liner than is the case with the just-described annular structure having the horizontal, vertical and convex portions. Another annular structure which can be utilized is one in which the structure is a concave groove having a radius at least equal to the radius of the convex outside edge of the lip.

There are other configurations which may be utilized, the only requirement being that the liner be pressed into a position around the outside edge of the lip and that the configuration results in an increasing of pressure between the liner and the outside edge of the lip as the top of the closure flexes upward in response to positive pressure in the container.

In a preferred embodiment, the closure of this invention utilizes a liner which is free to rotate with respect to the closure. As the closure is fitted to the container neck, this freedom to rotate will result in the liner being able to achieve and maintain essentially a single position on the container lip even though the closure continues to rotate as it is tightened to the container. If, on the other hand, the liner is fixed to the closure, it will, as the liner contacts the container lip, be rubbed over the lip surface as the closure is tightened on the container neck. Such liner-lip rubbing can be disadvantageous as each irregularity in the container lip will cause its particular liner deformation and such deformations will, when the closure reaches its final tightened position, almost always not coincide with the particular lip irregularity which caused the particular deformation. The result of this non-coincidence can be deleterious to seal fidelity as the contacting liner-lip sealing surfaces are not in as intimate contact as would be possible if the liner deformation matched the lip irregularity which caused it. In distinction, when the liner is free to rotate with respect to the closure, and thus not forced to rotate about the container lip, the liner is simply pressed downwardly onto the container lip to substantially a single position and each liner deformation caused by a particular lip irregularity will coincide with that irregularity. Matching of the liner deformations to the lip irregularities results in intimate contact and seal fidelity is enhanced.

To mitigate against the tendency of the liner to rotate with the closure as the closure is torqued to its tightened position, the liner should be of a composition that results in the friction between the liner and the closure being less than the friction between the container lip and the liner. This is most generally achieved by the liner composition having a higher coefficient of friction for the liner-lip contact than for the liner-closure contact. In some cases, e.g., when the container is of glass, this difference in friction can also be at least partially attributable to the fact that the container lip presents, to the liner, a surface which is more irregular than the closure surface contacted by the liner. Liner composition should also be such that the liner is flexible and resilient. Furthermore, since the closure of this invention is to be utilized on either glass or plastic containers, the liner should be made of a material which is compatible with the material of which the container is made. For example, liners made of materials which stick to the container lip should be avoided as unscrewing the closure from the container will be difficult and, even if achieved, could result in tearing of the liner. It has been found that liners made of an ethylene-vinyl acetate copolymer give superior results on both glass and plastic containers. Further, liners made of such copolymers are acceptable from a toxicological and odor standpoint when the container is utilized to hold consumable products such as carbonated beverages, beer, etc. Exemplary of suitable ethylene-vinyl acetate copolymer liner materials are ELVAX 760, 660, 460 and 360, all of which are marketed by E. I. DuPont de Nemours and Company, Wilmington, Del. 19898. Other materials acceptable from a manufacturing and consumer viewpoint may be used, e.g. polyvinyl chloride.

To help reduce the torque required to remove the closure from the container, it has been found useful to add to the liner composition a slip additive which will increase the liner's lubricity characteristics. When the liner is of a thermoplastic material, slip additives such as synthetic waxes or fatty amides are useful. A particularly useful slip additive is KEMAMIDE E, which is marketed by Humko Sheffield, a division of Kraft, Inc., White Station Tower, Memphis, Tenn. 38101. The amount of slip additive incorporated into the liner composition is best determined by trial and error. For any particular application, too much slip additive will result in the closure having a tendency to back off from its tightened position on the container neck. On the other hand, too little slip additive results in an increase in removal torque thereby making it difficult to unscrew the closure. Among the factors which may influence the amount of slip additive used are: container composition; closure composition; the extent of container lip irregularity; acceptable torque-on and -off limits; liner composition; and the extent of liner deformation desired at the point of seal with the given torque-on value selected. When utilizing (1) conventional containers made of glass or polyethylene terephthalate, (2) liners about 0.030 inches in thickness made of ethylene-vinyl acetate copolymers (e.g., ELVAX 760, 660, 460 or 360), and (3) closures made of polypropylene in a carbonated beverage closure-container-system having a torque-on value within the range of 12 to 20 inch-pounds and a torque-off value within the range of 3 to 18 inch-pounds, it has been found that about 0.5 weight percent KENAMIDE E is suitable. In other words, under the above parameters, the amount of the slip additive used will be approximately two grams per pound of liner material.

The remainder of the closure can be made of any moldable thermoplastic material which will provide the prior-described characteristics for the top wall of the closure. However, the thermoplastic material should not be so flexible that, under building positive container pressure, the sidewall of the closure will flex outwardly resulting in the closure threads jumping over the container threads. It has been found that a highly preferred thermoplastic material is polypropylene. Other thermoplastic materials which may be useful are polyethylene terephthalate, high density polyethylene, nylon, polyvinyl chloride, etc. Other materials which would be useful are well known to those skilled in the art given the preceding identified criteria.

These and other features contributing to satisfaction in use and economy in manufacture will be more fully understood when taken in connection with the following description of preferred embodiments and the accompanying drawings in which identical numerals refer to the identical parts and in which.

DESCRIPTION OF THE PREFERRED EMBODIMENTS

Figure 1:
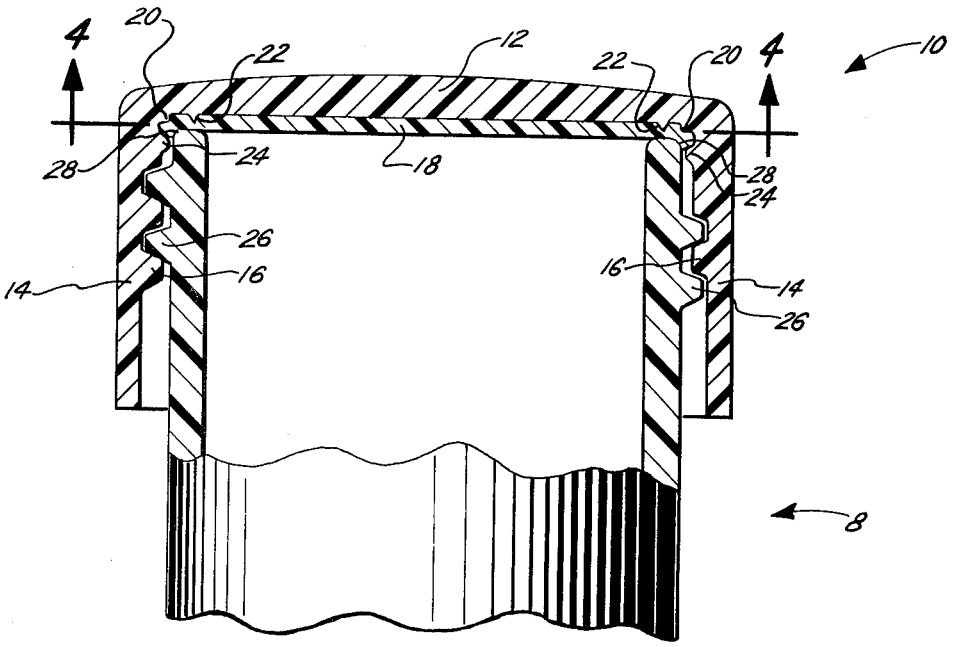
FIG. 1 is a partial sectional view showing a closure of this invention fitted to a container neck.
Figure 2:
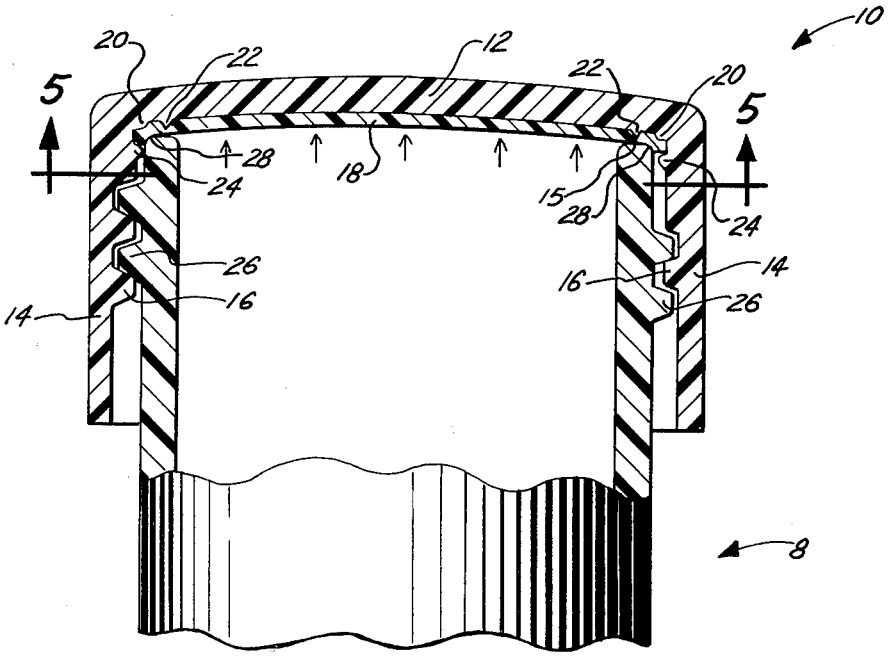
FIG. 2 is a partial sectional view of the closure shown in FIG. 1 under the influence of a positive pressure in the container.

Referring now to FIGS. 1-4, it can be seen that a closure, generally designated by the numeral 10, is fitted to a container neck, generally designated by the numeral 8. Container neck 8 has, about its outside surface and adjacent its upper end, helical thread 26. At the terminal end of container neck 8 there is a mouth through which the container contents are dispensed. Lip 15 defines the boundaries of the container mouth. As mentioned previously, the container with which closure 10 is utilized can be made of any suitable material, e.g., glass or a thermoplastic material such as polyethylene terephthalate, polyethylene, polyvinyl chloride, etc.

Figure 5:
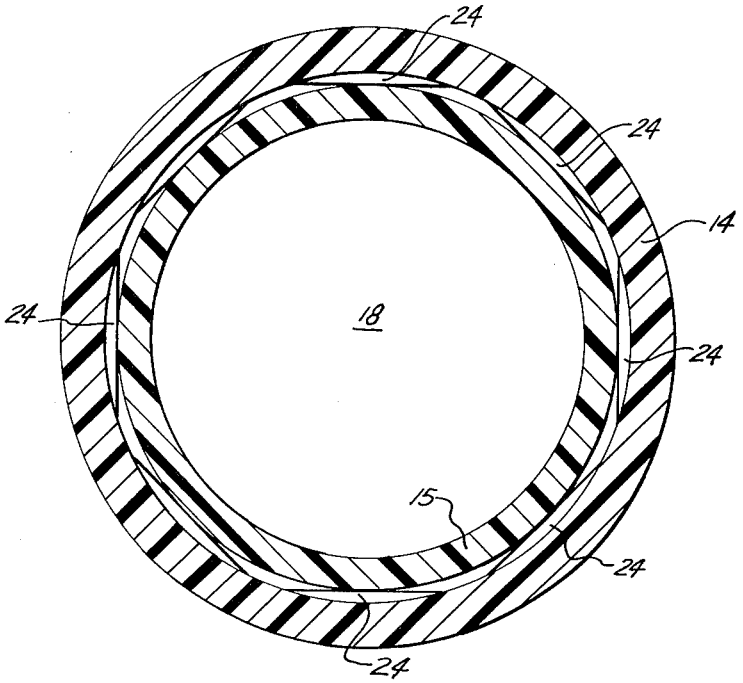
FIG. 5 is a sectional view taken along section lines 5—5 in FIG. 2.

Closure 10 has an annular top wall 12 with a sidewall 14 downwardly depending therefrom. About the inside surface of sidewall 14 there is provided helical closure thread 16 which is of a design whereby it cooperates with container helical thread 26 to achieve fitment of closure 10 to the container. In close proximity to top wall 20 there is provided liner 18. Liner 18 has a diameter greater than the outside diameter of container neck 8 measured at the container mouth. By having a greater diameter, liner 18 will be able to extend around the outside edge 28 of lip 15 to effect the seal of this invention. Liner 18 is prevented from moving away from top wall 12 by means of annular ring 24. Annular ring 24 may be continuous or discontinuous. Attention is drawn to FIG. 5 in which a discontinuous annular retaining ring 24 is shown. Projecting downwardly from top wall 12 there is provided annular tab 22. Annular tab 22 has a triangular shape when viewed in cross-section. See FIGS. 3, 6 and 7. Annular tab 22 is utilized to insure that liner 18 does not move laterally during the buildup of internal container pressure. Note that annular tab 22 is positioned so that it is over lip 15. By having annular tab 22 so positioned, it is assured that annular tab 22 will obtain a grip on liner 18 by penetration.

Figure 3:
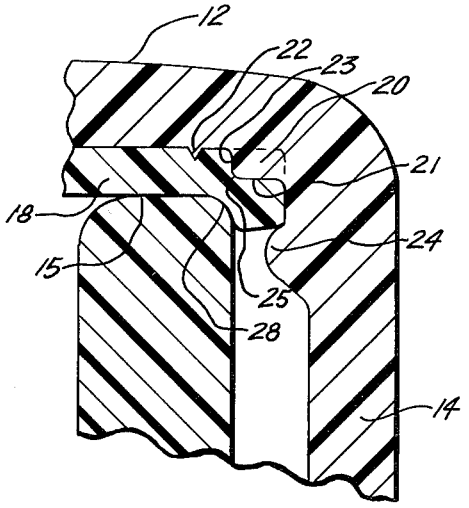
FIG. 3 is an enlarged sectional view of a portion of the container and closure shown in FIG. 2.
Figure 4:
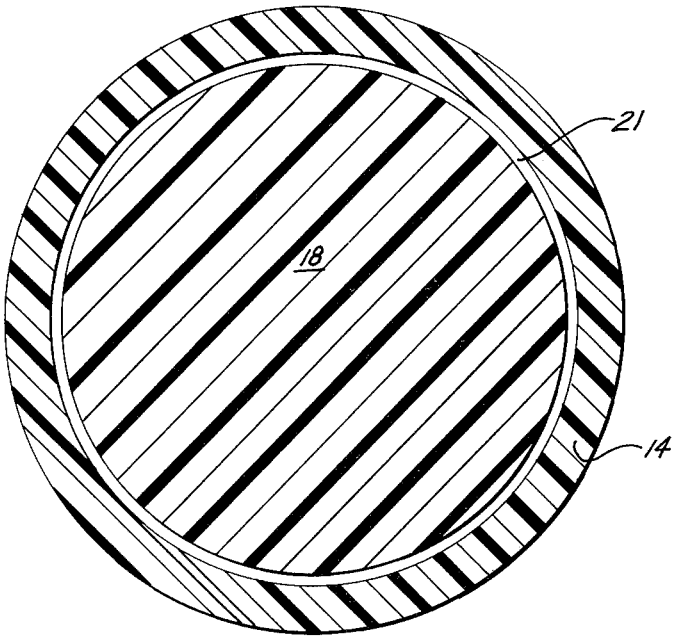
FIG. 4 is a sectional view taken along section lines 4—4 in FIG. 1.

Located adjacent the inside intersection of top wall 12 and downwardly depending sidewall 14 there is provided annular bead 20. An enlarged view of the cross-section of annular bead 20 is shown in FIG. 3. As can be seen in this configuration, annular bead 20 has a horizontal portion 21 and a vertical portion 23. Convex portion 25 connects horizontal portion 21 to vertical portion 23. Convex portion 25 is preferrably opposite the outside edge 28 of lip 15.

Figure 8:
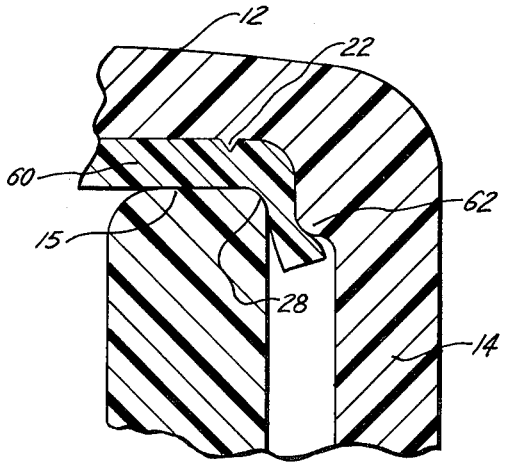
FIG. 8 is an enlarged sectional view showing a variation of the embodiment shown in FIG. 3.

FIG. 8 shows a variant of the closure shown in FIG. 3 in that liner 60 has a larger diameter than liner 18 shown in FIG. 3. This greater diameter results in the outside peripheral portion of liner 60 being pressed to a point extending further down on outside edge 28 of lip 15 so that the liner can compensate for chipped or irregular container lips. Annular bead 62 is in FIG. 8 is adjusted downwardly to affect a slightly lower point of pressure application on liner 60.

Figure 6:
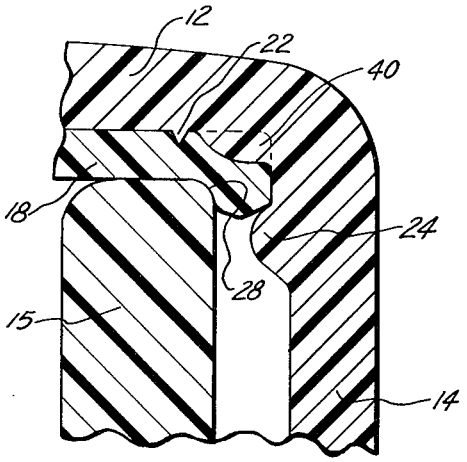
FIG. 6 is an enlarged sectional view showing a second embodiment of this invention.
Figure 7:
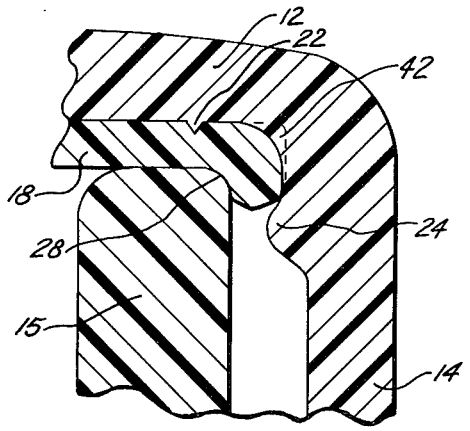
FIG. 7 is an enlarged sectional view showing a third embodiment of this invention.

In FIGS. 6 and 7, there is shown other configurations which may be utilized in place of annular bead 20. In FIG. 6, annular bead 40 is used in place of annular bead 20. Annular bead 40 has, for all practical purposes, no horizontal or vertical portions, but rather is simply a convex bead. Another configuration is shown in FIG. 7 in which the bead presents a concave profile when viewed in cross-section. This concave bead is labeled 42 and is shown in FIG. 7. When utilizing concave bead 42 it is preferable that the outside edge 28 of lip 15 be convex so that liner 18 is nested between concave bead 42 and outside edge 28.

FIGS. 3, 6, 7, and 8 show that the annular beads press against liner 18 to cause it to wrap around outside edge 28 of lip 15. When top wall 12 is flexed upwards due to pressure in the container the intersection of top wall 12 and sidewall 14 is brought inwardly towards outside edge 28. As a result of this movement, the annular bead, since it is integral with the intersection, will also move inwardly towards outside edge 28. Thus, liner 18 is pressed by the annular bead so that it wraps around outside edge 28. As the pressure in the container increases, the more top wall 12 will be urged to flex upwardly. The more top wall 12 is so urged, the more annular bead 40 will be urged inwardly. This urging of annular bead 40 will cause it to bear with more force on liner 18 thereby increasing the fidelity of seal between liner 18 and outside edge 28 of lip 15. Thus, it can be seen that an increase in container pressure results in an increase in the sealing effectiveness of the closure of this invention.

What is claimed is:

1. A thermoplastic closure for fitment to a container having a threaded neck terminating in a lip which defines an open mouth, said closure comprising:

a. a circular top wall;

b. an annular skirt downwardly depending from said top wall, said skirt having about its inside surface a closure thread for cooperation with said neck thread to achieve said fitment;

c. a circular, flexible, resilient ethylene-vinyl acetate copolymer liner positioned adjacent said top wall and having a diameter greater than the outside diameter of said lip said ethylene-vinyl acetate copolymer liner additionally containing a slip additive to improve the lubricity characteristics of said liner; and d. annular means for pressing said liner around the outside edge of said lip to form a gas-tight seal when said closure is fitted on said container, said annular means being located adjacent the inside intersection of said top wall and said skirt, and being configured to increase the fidelity of said gas-tight seal when said circular top wall is flexed upwardly.

2. The closure of claim 1 wherein said closure additionally has a retaining means about the inside surface of said skirt downwardly positioned below said annular means but above said closure thread for preventing said liner from moving down to said closure thread.

3. The closure of claim 2 wherein said closure additionally has an annular tab downwardly projecting from said top wall for engaging said liner to prevent said liner from pulling away from its seal position.

4. The closure of claim 3 wherein said closure is made of polypropylene.

5. The closure of claim 1 wherein said closure additionally has an annular tab downwardly projecting from said top wall for engaging said liner to prevent said liner from pulling away from its seal position.

6. The closure of claim 1 wherein said closure is made of polypropylene.

7. The closure of claim 1 wherein said liner is free to rotate with respect to said closure.

8. The closure of claim 1 wherein said resilient liner is free to rotate with respect to said closure and wherein the coefficient of friction between said liner and the inside surface of said top wall is less than the coefficient of friction between said liner and said lip.

9. The closure of claim 1 wherein said outside edge of said lip is convex and wherein said annular means is a concave groove.

10. The closure of claim 9 wherein said closure additionally has a retaining means about the inside surface of said skirt downwardly positioned below said annular means but above said closure thread for preventing said liner from moving down to said closure thread.

11. The closure of claim 10 wherein said closure additionally has an annular tab downwardly projecting from said top wall for engaging said liner to prevent said liner from pulling away from its seal position.

12. The closure of claim 11 wherein said closure is made of polypropylene.

13. The closure of claim 9 wherein the closure additionally has an annular tab downwardly projecting from said top wall for engaging said liner to prevent said liner from pulling away from its seal position.

14. The closure of claim 9 wherein said closure is made of polypropylene.

15. The closure of claim 9 wherein said resilient liner is free to rotate with respect to said closure.

16. A thermoplastic closure for fitment to a container having a threaded neck terminating in a lip which defines an open mouth, said closure comprising:

a. a circular top wall;

b. an annular skirt downwardly depending from said top wall, said skirt having about its inside surface a closure thread for cooperation with said neck thread to achieve said fitment;

c. a circular, flexible, resilient liner positioned adjacent said top wall and having a diameter greater than the outside diameter of said lip; and d. annular means for pressing said liner around the outside edge of said lip to form a gas-tight seal when said closure is fitted on said container, said annular means being located adjacent the inside intersection of said top wall and said skirt, said annular means having a configuration, when viewed in cross-section, which has a horizontal portion, a vertical portion and a convex portion, said convex portion connecting said horizontal portion and said vertical portion one to the other, whereby said annular means increases the fidelity of said gas-tight seal when said circular top wall is flexed upwardly.

17. The closure of claim 16 wherein said closure additionally has a retaining means about the inside surface of said skirt downwardly positioned below said annular means but above said closure thread for preventing said liner from moving down to said closure thread.

18. The closure of claim 17 wherein said closure additionally has an annular tab downwardly projecting from said top wall for engaging said liner to prevent said liner from pulling away from its seal position.

19. The closure of claim 18 wherein said closure is made of polypropylene and said liner is an ethylene-vinyl acetate copolymer.

20. The closure of claim 16 wherein said closure additionally has an annular tab downwardly projecting from said top wall for engaging said liner to prevent said liner from pulling away from its seal position.

21. The closure of claim 16 wherein said closure is made of polypropylene.

22. The closure of claim 21 wherein said liner is an ethylene-vinyl acetate copolymer.

23. The closure of claim 16 wherein said liner is an ethylene-vinyl acetate copolymer.

24. The closure of claim 23 wherein said liner additionally contains a slip additive to improve the lubricity characteristics of said liner.

25. The closure of claim 16 wherein said resilient liner is free to rotate with respect to said closure and wherein the coefficient of friction between said liner and the inside surface of said top wall is less than the coefficient of friction between said liner and said lip.

26. The closure of claim 16 wherein said resilient liner is free to rotate with respect to said closure.

27. A thermoplastic closure for fitment to a container having a threaded neck terminating in a lip which defines an open mouth, said closure comprising:

a. a circular top wall;

b. an annular skirt downwardly depending from said top wall, said skirt having about its inside surface a closure thread for cooperation with said neck thread to achieve said fitment;

c. a circular, flexible, resilient liner positioned adjacent said top wall and having a diameter greater than the outside diameter of said lip; and d. an annular convex bead for pressing said liner around the outside edge of said lip to form a gas-tight seal when said closure is fitted on said container, said annular convex bead being located adjacent the inside section of said top wall and said skirt, whereby said annular convex bead increases the fidelity of said gas-tight seal when said circular top wall is flexed upwardly.

28. The closure of claim 27 wherein said closure additionally has a retaining means about the inside of said skirt downwardly positioned below said annular means but above said closure threads for preventing said liner from moving down to said closure thread.

29. The closure of claim 28 wherein said closure additionally has an annular tab downwardly projecting from said top wall for engaging said liner to prevent said liner from pulling away from its seal position.

30. The closure of claim 29 wherein said closure is made of polypropylene and said liner is an ethylene-vinyl acetate copolymer.

31. The closure of claim 29 wherein said closure additionally has an annular tab downwardly projecting from said top wall for engaging said liner to prevent said liner from pulling away from its seal position.

32. The closure of claim 27 wherein said closure is made of polypropylene.

33. The closure of claim 32 wherein said liner is an ethylene-vinyl acetate copolymer.

34. The closure of claim 27 wherein said liner is an ethylene-vinyl acetate copolymer.

35. The closure of claim 34 wherein said liner additionally contains a slip additive to improve the lubricity characteristics of said liner.

36. The closure of claim 27 wherein said resilient liner is free to rotate with respect to said closure and wherein the coefficient of friction between said liner and the inside surface of said top wall is less than the coefficient of friction between said liner and said lip.

37. The closure of claim 27 wherein said resilient liner is free to rotate with respect to said closure.

38. A thermoplastic closure for fitment to a container having a threaded neck terminating in a lip with a convex outside edge which defines an open-mouth, said closure comprising:

a. a circular top wall;

b. an annular skirt downwardly depending from said top wall, said skirt having about its inside surface a closure thread for cooperation with said neck thread to achieve said fitment;

c. a circular, flexible, resilient, ethylene-vinyl acetate copolymer liner positioned adjacent said top wall and free to rotate with respect thereto and having a diameter greater than the outside diameter of said convex lip, said liner additionally containing a slip additive to improve the lubricity characteristics of said liner;

d. an annular concave groove for pressing said liner around the convex outside edge of said lip to form a gas-tight seal when said closure is fitted on said container, said annular groove being located adjacent the inside intersection of said top wall and said skirt, whereby said concave groove increases the fidelity of said gas-tight seal when said circular top wall is flexed upwardly; and e. retaining means about the inside surface of said skirt downwardly positioned below said concave groove but above said closure thread for preventing said liner from moving down to said closure thread.

39. The closure of claim 38 wherein the closure additionally has an annular tab downwardly projecting from said top wall for engaging said liner to prevent said liner from pulling away from its seal position.

40. The closure of claim 38 wherein said closure is made of polypropylene.

41. The closure of claim 38 wherein the coefficient of friction between said liner and the inside surface of said top wall is less than the coefficient of friction between said liner and said lip.

42. A thermoplastic closure for fitment to a container having a threaded neck terminating in a lip which defines an open mouth, said closure comprising:

a. a circular top wall;

b. an annular skirt downwardly depending from said top wall, said skirt having about its inside surface a closure thread for cooperation with said neck thread to achieve said fitment;

c. a circular, flexible, resilient liner positioned adjacent said top wall and having a diameter greater than the outside diameter of said lip, said resilient liner being free to rotate with respect to said closure and wherein the coefficient of friction between said liner and the inside surface of said top wall is less than the coefficient of friction between said liner and said lip; and d. annular means for pressing said liner around the outside edge of said lip to form a gas-tight seal when said closure is fitted on said container, said annular means being located adjacent the inside intersection of said top wall and said skirt, and being configured to increase the fidelity of said gas-tight seal when said circular top wall is flexed upwardly.

43. The closure of claim 42 wherein said outside edge of said lip is convex and said annular means is a concave groove.

44. The closure of claim 42 wherein said closure additionally has a retaining means about the inside surface of said skirt downwardly positioned below said annular means but above said closure thread for preventing said liner from moving down to said closure thread.

45. The closure of claim 44 wherein said closure additionally has an annular tab downwardly projecting from said top wall for engaging said liner to prevent said liner from pulling away from its seal position.

46. The closure of claim 45 wherein said closure is made of polypropylene and said liner is an ethylene-vinyl acetate copolymer.

47. The closure of claim 42 wherein the closure additionally has an annular tab downwardly projecting from said top wall for engaging said liner to prevent said liner from pulling away from its seal position.

48. The closure of claim 42 wherein said closure is made of polypropylene.

49. The closure of claim 48 wherein said liner is an ethylene-vinyl acetate copolymer.

50. The closure of claim 42 wherein said liner is an ethylene-vinyl acetate copolymer.

51. The closure of claim 50 wherein said liner additionally contains a slip additive to improve the lubricity characteristics of said liner.

* * * * *

Notice of Adverse Decision in Interference

In Interference No. 101,442, involving Patent No. 4,462,502, W. R. Luenser and E. M. Ostrowsky, THREADED CLOSURE WITH LINER, final judgment adverse to the patentees, was rendered Feb. 26, 1986, as to claims 16, 17, 21–23, 26–28, 32–34 and 37.

[*Official Gazette June 17, 1986.*]